US009121667B1

(12) United States Patent
Kohnen et al.

(10) Patent No.: US 9,121,667 B1
(45) Date of Patent: Sep. 1, 2015

(54) MORTAR

(71) Applicant: Rheinmetall Waffe Munition GmbH, Unterluss (DE)

(72) Inventors: Norbert Kohnen, Viersen (DE); Berthold Baumann, Eschede (DE); Ralf-Joachim Herrmann, Königs Wusterhausen (DE)

(73) Assignee: Rheinmetall Waffe Munition GmbH, Unterlüss (DE)

( * ) Notice: Subject to any disclaimer, the term of this patent is extended or adjusted under 35 U.S.C. 154(b) by 0 days.

(21) Appl. No.: 14/310,456

(22) Filed: Jun. 20, 2014

Related U.S. Application Data

(60) Division of application No. 13/102,913, filed on May 6, 2011, now Pat. No. 8,794,120, which is a continuation-in-part of application No. PCT/EP2009/007392, filed on Oct. 15, 2009.

(30) Foreign Application Priority Data

Nov. 6, 2008 (DE) ..... 10 2008 056 112

(51) Int. Cl.
*F41F 1/06* (2006.01)
*F41A 27/28* (2006.01)

(52) U.S. Cl.
CPC .. *F41F 1/06* (2013.01); *F41A 27/28* (2013.01)

(58) Field of Classification Search
CPC ..... F41F 1/06; F41A 27/22; F41A 27/24; F41A 27/28
USPC ..... 89/37.01, 37.05, 37.07, 37.12, 40.02, 89/41.01, 41.02, 41.17
See application file for complete search history.

(56) References Cited

U.S. PATENT DOCUMENTS 477,946 A 6/1892 Livingston et al.
1,445,126 A 2/1923 Bergman
(Continued)

FOREIGN PATENT DOCUMENTS

DE 31 21 999 A1 12/1982
DE 34 23 010 A1 1/1986
(Continued)

OTHER PUBLICATIONS

Plastic Deformation at http://www.matter.org.uk/schools/content/hookeslaw/plastic.html, downloaded Apr. 20, 2011, 1 page.
(Continued)

*Primary Examiner* — Gabriel Klein
(74) *Attorney, Agent, or Firm* — Griffin & Szipl, P.C.

(57) ABSTRACT

A mortar includes at least one barrel mounted movably over a ball journal in a bottom supporting device, and an aiming device serving to aim the barrel vertically and horizontally. In order to be able to aim the barrel of the mortar automatically in a simple and cost advantageous manner, the aiming device preferably comprises a carriage that can be moved along guideways essentially horizontally towards or away from the barrel. At the carriage, the first end region of a pivoted arm is mounted so that it can be rotated about a pivot axis, and the second end region of the pivoted arm is connected with a spherical plain bearing, guiding the barrel. The spherical plain bearing embraces a housing part, which is open at its end faces and in which an inner part is mounted spherically (rotatably), which contains a cylindrical barrel guide, for movably accommodating the barrel.

11 Claims, 6 Drawing Sheets

(56) References Cited

U.S. PATENT DOCUMENTS

| | | | |
|---|---|---|---|
| 1,524,273 | A | 1/1925 | Newton |
| 2,030,507 | A | 2/1936 | Driggs |
| 2,197,816 | A | 4/1940 | Tate |
| 2,337,309 | A | 12/1943 | Caulkins |
| 2,337,647 | A | 12/1943 | Caulkins |
| 2,353,971 | A | 7/1944 | Shaffer et al. |
| 2,438,165 | A | 3/1948 | Haas |
| 2,922,338 | A | 1/1960 | Barbe |
| 3,011,407 | A | 12/1961 | Van Koningsweld |
| 3,124,070 | A | 3/1964 | Jasse |
| 3,208,348 | A | 9/1965 | Lee |
| 3,326,082 | A | 6/1967 | Johnson, Jr. et al. |
| 3,501,997 | A | 3/1970 | Winsen et al. |
| 3,512,449 | A | 5/1970 | Stoner |
| 3,672,255 | A | 6/1972 | Findlay et al. |
| 3,738,219 | A | 6/1973 | Febres |
| 3,771,417 | A | 11/1973 | Schnabele et al. |
| 3,800,656 | A | 4/1974 | Schnabele |
| 3,818,794 | A | 6/1974 | Mayer et al. |
| 3,838,622 | A | 10/1974 | Febres |
| 3,894,473 | A | 7/1975 | Marest et al. |
| 3,946,637 | A | 3/1976 | Campagnuolo et al. |
| 4,011,794 | A | 3/1977 | Leshem |
| 4,019,423 | A | 4/1977 | Johnson |
| 4,022,102 | A | 5/1977 | Ettel |
| 4,088,057 | A | 5/1978 | Nasypany |
| 4,157,054 | A | 6/1979 | Cobb |
| 4,172,420 | A | 10/1979 | Voss et al. |
| 4,198,897 | A | 4/1980 | Lipp et al. |
| 4,354,572 | A | 10/1982 | Martin |
| 4,406,209 | A | 9/1983 | Arene et al. |
| 4,489,639 | A | 12/1984 | Winkler et al. |
| 4,549,487 | A | 10/1985 | Jensen |
| 4,583,444 | A | 4/1986 | Jackson |
| 4,607,562 | A | 8/1986 | LeBlanc |
| 4,616,127 | A | 10/1986 | Whiting |
| 4,669,357 | A | 6/1987 | von Laar et al. |
| 4,682,528 | A | 7/1987 | Wohler |
| 4,686,885 | A | 8/1987 | Bai |
| 4,711,180 | A | 12/1987 | Smolnik |
| 4,721,026 | A | 1/1988 | Arana Ibarra |
| 4,753,156 | A | 6/1988 | Winkler et al. |
| 4,898,097 | A | 2/1990 | Jordan et al. |
| 4,949,491 | A | 8/1990 | Broske |
| 4,974,491 | A | 12/1990 | von Laar et al. |
| 5,050,479 | A | 9/1991 | Heintz et al. |
| 5,123,329 | A | 6/1992 | Irwin |
| 5,160,801 | A | 11/1992 | Andersen et al. |
| 5,343,795 | A | 9/1994 | Ziemba et al. |
| 5,491,917 | A | 2/1996 | Dihan et al. |
| 5,677,507 | A | 10/1997 | Becker et al. |
| 5,827,991 | A | 10/1998 | Predazzer |
| 6,000,313 | A | 12/1999 | Becker |
| 6,095,026 | A | 8/2000 | Poussard et al. |
| 6,237,463 | B1 | 5/2001 | Grizzaffi |
| 6,286,408 | B1 | 9/2001 | Sanford et al. |
| 6,289,780 | B1 | 9/2001 | Heldmann |
| 6,457,396 | B1 | 10/2002 | Bean et al. |
| 6,460,448 | B1 | 10/2002 | Zangrando |
| 6,591,733 | B1 | 7/2003 | Engstrom |
| 6,684,547 | B2 | 2/2004 | Poff, Jr. |
| 6,769,344 | B2 | 8/2004 | Domeji |
| 7,124,690 | B1 | 10/2006 | Tadros et al. |
| 7,448,306 | B2 | 11/2008 | Shipman et al. |
| 7,669,513 | B2 | 3/2010 | Niv et al. |
| 8,418,389 | B1 | 4/2013 | Lukman et al. |
| 2003/0056639 | A1 | 3/2003 | Giza |
| 2004/0216597 | A1 | 11/2004 | Kohlstedt et al. |
| 2005/0268806 | A1 | 12/2005 | Harjula et al. |
| 2006/0288857 | A1 | 12/2006 | Laine |
| 2007/0074625 | A1 | 4/2007 | Seidenstricker et al. |
| 2007/0119296 | A1 | 5/2007 | Niv et al. |
| 2007/0241227 | A1 | 10/2007 | Zemany et al. |
| 2009/0126558 | A1 | 5/2009 | Kohnen |
| 2010/0170128 | A1 | 7/2010 | Werner |
| 2010/0192439 | A1 | 8/2010 | Murello |
| 2010/0269681 | A1 | 10/2010 | Shipman et al. |
| 2012/0255426 | A1 | 10/2012 | Reynard et al. |

FOREIGN PATENT DOCUMENTS

| | | | |
|---|---|---|---|
| DE | 197 13 192 | A1 | 10/1998 |
| DE | 10 2004 050 215 | A1 | 2/2006 |
| DE | 10 2004 050 218 | A1 | 2/2006 |
| DE | 10 2006 014 155 | A1 | 9/2007 |
| DE | 10 2006 029330 | A1 | 12/2007 |
| EP | 0 429 320 | A1 | 5/1991 |
| EP | 0 965 814 | A2 | 12/1999 |
| FR | 2532413 | A1 | 3/1984 |
| FR | 2 647 888 | A1 | 12/1990 |
| GB | 2131928 | A | 6/1984 |
| GB | 2 325 509 | A | 11/1998 |
| WO | 97/48959 | A1 | 12/1997 |
| WO | 2005/075933 | A1 | 8/2005 |

OTHER PUBLICATIONS

International Search Report issued in application No. PCT/EP2009/007392, completed Jan. 20, 2010 and mailed Jan. 29, 2010.

Office Action issued in related U.S. Appl. No. 13/089,040 on Oct. 23, 2012.

Office Action issued on Jun. 28, 2013 in related U.S. Appl. No. 13/101,804.

MORTAR

This is a Divisional Application of U.S. Ser. No. 13/102,913 filed May 6, 2011, which is a Continuation-in-Part Application in the United States of International Patent Application No. PCT/EP2009/007392 filed Oct. 15, 2009, which claims priority on German Patent Application No. DE 10 2008 056 112.6, filed Nov. 6, 2008. The entire disclosures of the above patent applications are hereby incorporated by reference.

FIELD OF THE INVENTION

The invention relates to a mortar having at least one weapon barrel, which is mounted so that it can move via a ball-ended rod in a supporting device at the bottom, and has an aiming system that is used for elevation and azimuth aiming of the weapon barrel.

BACKGROUND OF THE INVENTION

Mortars for infantry operations are normally set up manually, with the weapon barrel being aimed manually by an appropriate aiming means, once the firing point has been surveyed. Because the weapon barrel is moved easily after firing a shot, it must be re-aimed manually after each shot in order to maintain a predetermined hit probability.

By way of example, the documents DE 31 21 999 A1 and DE 197 13 192 C2 disclose vehicle-mounted mortars, in which the aiming process for the weapon barrel can be carried out with the aid of mechanical drive means from the interior of the vehicle.

Furthermore, WO 97/48959 A1 discloses a howitzer, which comprises at least one weapon barrel that can be pivoted, an actuating mechanism for barrel adjustment, and an aiming device for the actuating mechanism, in order to align the weapon barrels. The aiming device itself has an autonomous aiming appliance, which is preferably arranged separately from the actuating mechanism and via which the actuating mechanism can be operated and/or controlled in order to aim the weapon barrel in azimuth and elevation, in the sense of a rotary movement of each barrel axis along a conical surface about a vertical axis and/or a pivoting movement along the axial plane through the vertical axis.

The invention is based on the object of specifying a mortar whose aiming system is designed to allow automatic aiming in a simple manner, in particular, of a weapon barrel that is supported on the ground.

SUMMARY OF THE INVENTION

According to the invention, this object is achieved by the features of a first illustrative embodiment, which pertains to a mortar having at least one weapon barrel (2) which, for example, is mounted so that it can move via a ball-ended rod (3) in a supporting device (4) at the bottom, and has an aiming system (5) that is used for elevation and azimuth aiming of the weapon barrel (2), characterized in that the aiming system (5) comprises a hinged bearing (17) having a housing part (19) that is open at its end faces and on the outside of which a pivoting arm (13) is mounted so that it can rotate about a horizontal axis (20), and in which a spherically (rotatably) mounted inner part (21) is located, which is connected to a cylindrical barrel guide (22) for movable accommodation of the weapon barrel (2). Furthermore, particularly advantageous refinements of the invention are disclosed as additional illustrative embodiments. For example, in accordance with a second illustrative embodiment of the present invention, the first illustrative embodiment is modified so that the aiming system (5) furthermore comprises a carriage (6) or the like, which can be moved along at least one guide path (7) substantially horizontally toward the weapon barrel (2) or away from it.

In accordance with a third illustrative embodiment of the present invention, the first illustrative embodiment is modified so that the first end area (10) of a pivoting arm (13) is mounted on the carriage (6) so that it can rotate about a pivoting axis (14), which is arranged at right angles to the plane of the carriage (6), and the second end area (16) of the pivoting arm (13) is connected to a hinged bearing (17), which is at a distance from the bottom supporting device (4) and guides the weapon barrel (2). In accordance with a fourth illustrative embodiment of the present invention, the first illustrative embodiment is modified so that, in order to move the carriage (6) along the guide path (7), the carriage (6) is connected to a first drive unit, which comprises a first actuating motor.

In accordance with a fifth illustrative embodiment of the present invention, the first illustrative embodiment or the second illustrative embodiment is further modified so that, in order to pivot the pivoting arm (13), this pivoting arm (13) is connected to a second drive unit (15), which comprises a second actuating motor. In accordance with a sixth illustrative embodiment of the present invention, the first illustrative embodiment, the second illustrative embodiment, and the third illustrative embodiment are further modified so that the pivoting arm (13) consists of two parts (11, 12) which are arranged parallel to one another, are in the form of rods or tubes, surround the housing part (19) of the hinged bearing (17) at the side, and are connected to the housing part (19) via bearing journals (18) such that they can pivot. In accordance with a seventh illustrative embodiment of the present invention, the first illustrative embodiment, the second illustrative embodiment, the third illustrative embodiment, the fourth illustrative embodiment, the fifth illustrative embodiment, and the sixth illustrative embodiment, are further modified so that a device (26) for determining the three-dimensional barrel orientation is attached to the cylindrical barrel guide (22) of the hinged bearing (17), and acts on the first and second drive units (9, 15) via an electronic control device. In accordance with an eighth embodiment of the present invention, the first illustrative embodiment, the second illustrative embodiment, the third illustrative embodiment, the fourth illustrative embodiment, the fifth illustrative embodiment, the sixth illustrative embodiment, and the seventh illustrative embodiment, are further modified so that a control device (27) is provided on the housing part (19) for manual adjustment of the hinged bearing (17) in azimuth.

In accordance with a ninth illustrative embodiment of the invention, the first illustrative embodiment, the second illustrative embodiment, the third illustrative embodiment, the fourth illustrative embodiment, the fifth illustrative embodiment, the sixth illustrative embodiment, the seventh illustrative embodiment, and the eighth illustrative embodiment, are further modified so that the guide path (7) is a guide strip that is in the form of a rail and is arranged on or adjacent to a base frame (8). In accordance with a tenth illustrative embodiment of the present invention, the first illustrative embodiment, the second illustrative embodiment, the third illustrative embodiment, the fourth illustrative embodiment, the fifth illustrative embodiment, the sixth illustrative embodiment, the seventh illustrative embodiment, and the eighth illustrative embodiment are further modified so that a bearing ball (23) is attached to the cylindrical barrel guide (22), which bearing ball (23) surrounds the barrel guide (22) and is at least partially accommodated by corresponding bearing shells (24) that are connected to the housing part (19). In accordance with an eleventh illustrative embodiment of the invention, the tenth illustrative embodiment is further modified so that the barrel guide (22) and the bearing ball (23) are integrally connected to one another. In accordance with a twelfth illustrative embodiment of the present invention, the tenth illustrative embodiment and the eleventh illustrative embodiment are further modified so that, on its side facing the muzzle of the weapon barrel (2) and/or the side facing the bottom supporting device (4), the bearing ball (23) has externally visible annular markings (25), as alignment aids. In accordance with a thirteenth illustrative embodiment of the present invention, the twelfth illustrative embodiment is further modified so that the markings (25) are depressions that are incorporated in the bearing ball (23).

In accordance with a fourteenth illustrative embodiment of the present invention, the first illustrative embodiment, the second illustrative embodiment, the third illustrative embodiment, the fourth illustrative embodiment, the fifth illustrative embodiment, the sixth illustrative embodiment, the seventh illustrative embodiment, the eighth illustrative embodiment, the ninth illustrative embodiment, the tenth illustrative embodiment, the eleventh illustrative embodiment, and the thirteenth illustrative embodiment are further modified so that the aiming system (5) of the mortar (1) is arranged on a carrier vehicle (28). In accordance with a fifteenth embodiment of the present invention, the fourteenth embodiment is further modified so that the bottom supporting device (4) of the mortar (1) is either connected to the structure of the carrier vehicle (28) or rests on an earth bed (29) that is located adjacent to the carrier vehicle (28).

The invention is essentially based on the idea that the weapon barrel mounting consists of a housing part in which an inner part is mounted spherically. The inner part contains a cylindrical barrel guide, in which the weapon barrel can be moved axially and is guided radially, so that the inner part is always parallel to the axis of the weapon barrel. This allows decoupled mounting, parallel to the axis, of a system that is used to determine the three-dimensional barrel orientation, for example, a gyroscope system, on the inner part. The attachment of the system to the barrel guide, which is arranged parallel to the axis of the weapon barrel, rather than to the weapon barrel itself, means that the system is not loaded by the recoil forces from the weapon barrel. Furthermore, the spherical bearing of the weapon barrel makes it possible to freely choose the height and lateral offset with respect to the mortar barrel aiming appliance for the orientation of a bottom support plate of the mortar.

The aiming system furthermore preferably comprises a carriage, or the like, which can be moved along at least one guide path substantially horizontally toward the weapon barrel or away from it, wherein the first end area of a pivoting arm is mounted on the carriage such that it can rotate about a pivoting axis, which is arranged at right angles to the plane of the carriage, and wherein the second end area of the pivoting arm is connected to the cylindrical barrel guide. In order to move the carriage along the guide path, the carriage is connected to a first drive unit, which comprises a first actuating motor. In order to pivot the pivoting arm, this pivoting arm is connected to a second drive unit, which comprises a second actuating motor.

In one advantageous embodiment of the invention, the pivoting arm consists of two parts that are arranged parallel to one another, are in the form of rods or tubes, surround the housing part of the hinged bearing at the side, and are connected to the housing part via bearing journals so that they can pivot.

In order to automatically re-aim the weapon barrel after a shot has been fired, the gyroscope system functionally interacts with the drive units. As soon as this system finds a discrepancy in the orientation of the weapon barrel, electrical actuating signals are produced by means of an electronic control unit, and act on the first and second drive units. The gyroscope system produces the electrical signals, which describe the orientation of the weapon barrel in three dimensions. This information is compared with the elevation and azimuth angles required to attack the target, and actuating signals for the aiming unit are generated therefrom with the aid of the electronic control unit.

A manual control device can be provided, arranged on the housing part, for manual adjustment of the hinged bearing in azimuth. This allows the target coordinates to be input/transferred manually, the aiming system to be switched on and off manually, and the drives to be controlled manually. The guide path or paths along which the carriage can be moved may be in the form of guide strips that are in the form of rails, and are arranged on or adjacent to a base frame (i.e., a mount).

In one particularly expedient embodiment of the invention, a bearing ball is attached to the cylindrical barrel guide, wherein the bearing ball surrounds the barrel guide and is at least partially accommodated by corresponding bearing shells that are connected to the housing part. In this case, the barrel guide and the bearing ball may be formed integrally. Expediently, on its side facing the muzzle and/or the side facing the bottom supporting device, the bearing ball can have externally visible annular markings, as alignment aids, in which case the markings are depressions, for example grooves, which are incorporated in the bearing ball.

In a further embodiment of the invention, the aiming system is, for example, arranged at the rear on a carrier vehicle, with the bottom hinged bearing of the mortar either connected to the structure of the carrier vehicle or resting on an earth bed that is located adjacent to the carrier vehicle.

BRIEF DESCRIPTION OF THE DRAWINGS

Further details and advantages of the invention will become evident from the following exemplary embodiment, which will be explained with reference to figures, in which.

DETAILED DESCRIPTION OF THE INVENTION

Figure 1:
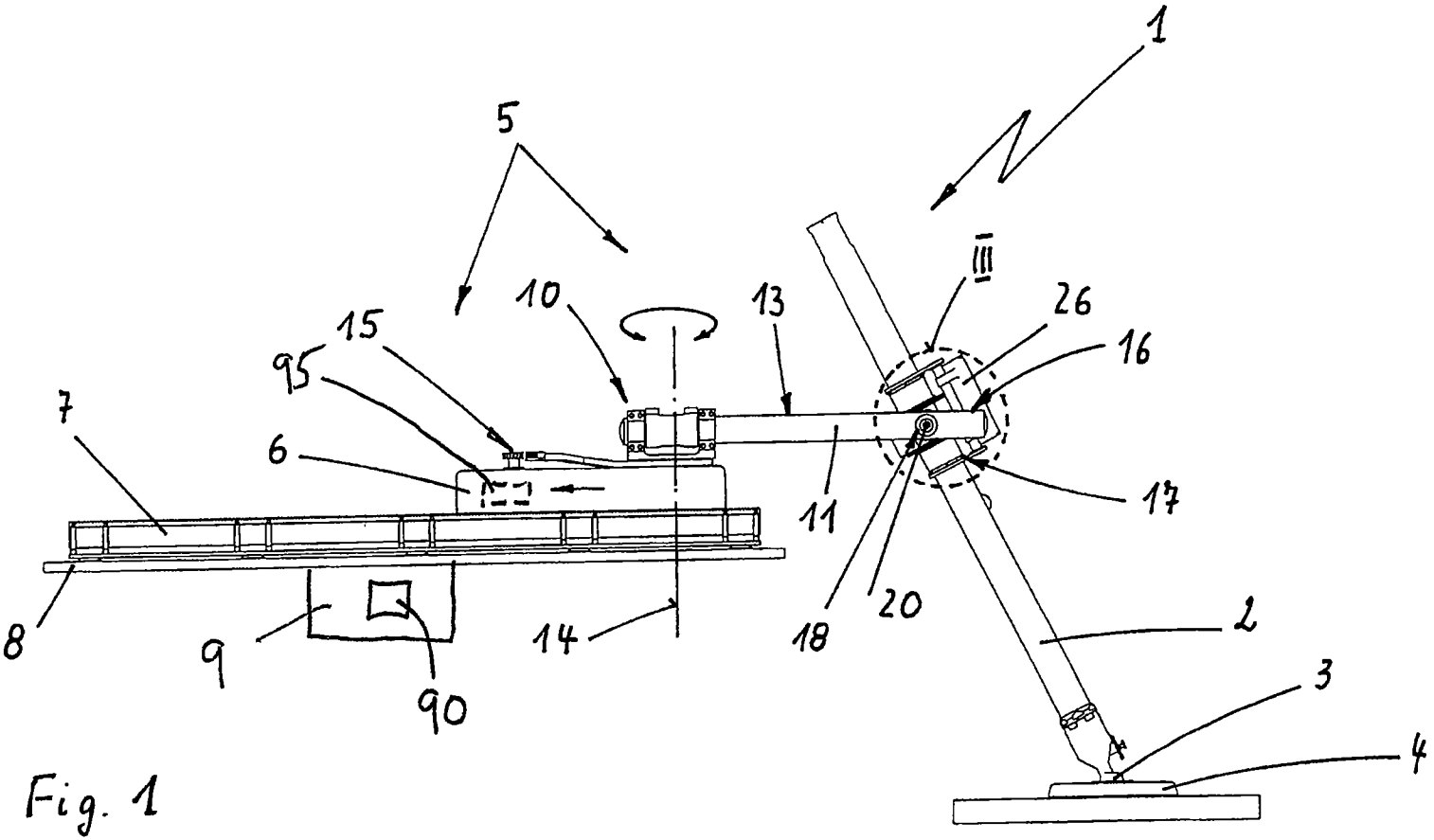
FIG. 1 shows a side view of a mortar according to the invention, in a predetermined initial position.

In the figures, 1 denotes a mortar according to the invention, which has a weapon barrel 2 that is mounted so that it can move via a ball-ended rod 3 in a bottom supporting device 4. In addition, an aiming system 5 is provided for elevation and azimuth aiming of the weapon barrel 2.

The aiming system 5 comprises a carriage 6 that can be moved substantially horizontally along the guide paths 7 toward the weapon barrel 2 or away from it. In this case, the guide paths 7 are guide strips, which are in the form of rails and are arranged on a base frame (i.e., a mount) 8.

In order to move the carriage 6 along these guide strips 7, the carriage 6 is connected (not illustrated) to a first drive unit 9 (elevation aiming drive), which comprises a first actuating motor 90.

The first end area 10 of a pivoting arm 13, which consists of two tubular parts 11, 12 (FIG. 2) that are arranged parallel to one another, is mounted on the carriage 6 such that the pivoting arm 13 can rotate about a pivoting axis 14 that is arranged at right angles to the plane of the carriage 6. The pivoting movement of the pivoting arm 13 is carried out by means of a second drive unit 15 (azimuth aiming drive), which comprises a second actuating motor 95.

The second end area 16, which is opposite the first end area 10, of the pivoting arm 13 is connected to a hinge bearing 17, which is located at a distance from the bottom supporting device 4 and guides the weapon barrel 2. The two tubular parts 11,12, which are arranged parallel to one another, of the pivoting arm 13 surround the hinged bearing 17 at the sides, and are connected to the hinged bearing 17 via bearing journals 18 so that the two tubular parts 11, 12 can pivot.

Figure 3:
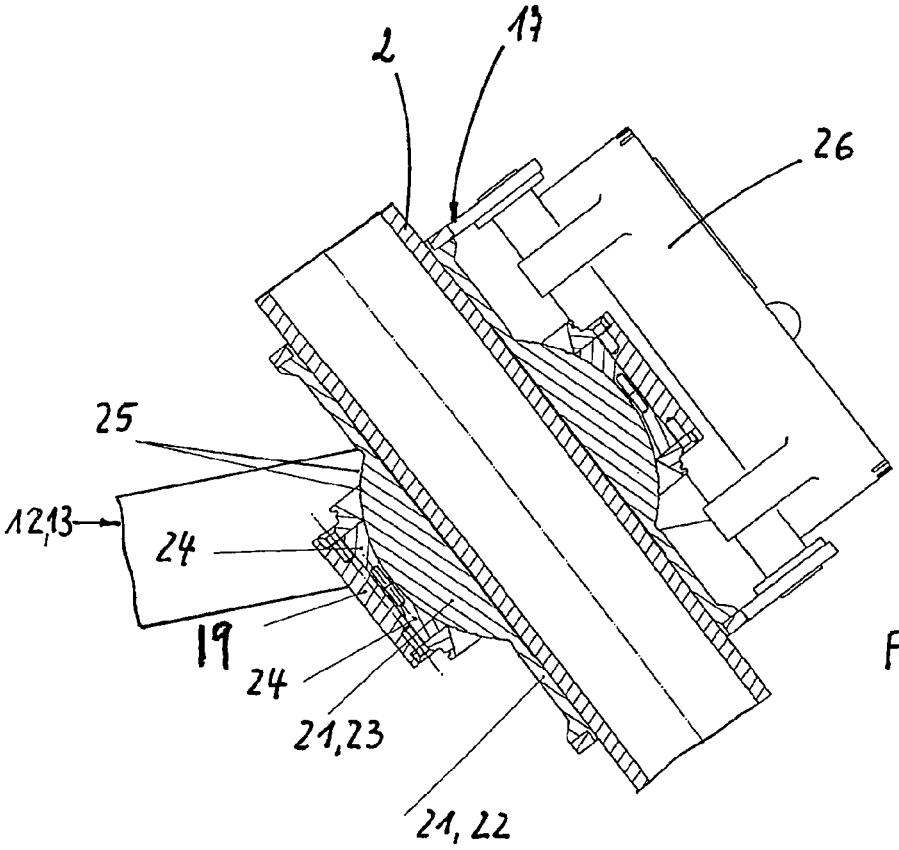
FIG. 3 shows an enlarged illustration of a cross section through the area annotated III in FIG. 1.

The hinged bearing 17 consists substantially of a housing part 19 (See FIG. 3), which is open on both end faces and on the outside of which the two tubular parts 11, 12 of the pivoting arm 13 are mounted such that they can rotate about a horizontal axis 20 (which is parallel to the elevation aiming axis). An inner part 21 is mounted rotatably within the hinged bearing 17, and comprises a cylindrical barrel guide 22 for accommodating the weapon barrel 2 so that the weapon barrel 2 can move within the cylindrical barrel guide 22.

A bearing ball 23, which surrounds the barrel guide 22, is integrally connected to the cylindrical barrel guide 22. This bearing ball 23 is partially held on the outside surface by corresponding bearing shells 24, which are connected to the housing part 19.

On its sides facing the muzzle of the weapon barrel and facing the bottom supporting device 4, the bearing ball 23 has externally visible annular depressions 25 that can be used as alignment aids, in particular, for manual alignment of the weapon barrel 2.

Figure 7:
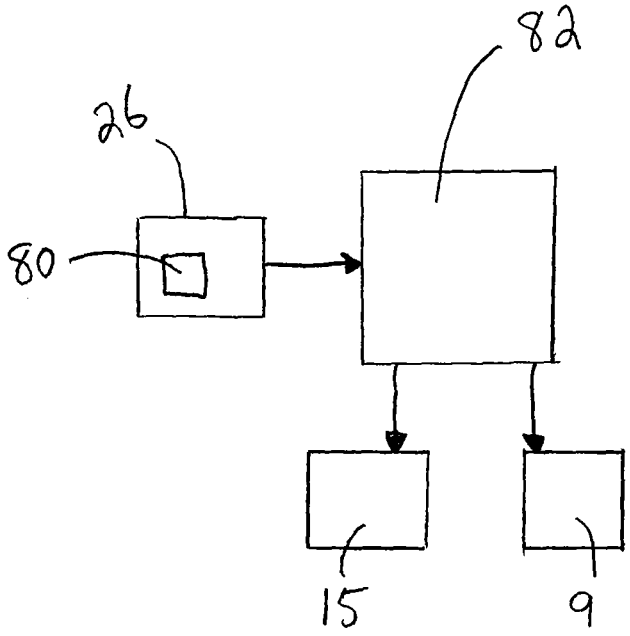
FIG. 7 shows a schematic of the control system for the mortar, which includes an electronic control unit 82 connected to receive electronic signals produced by a device 26 for determining the three-dimensional barrel orientation, and the electronic control unit outputs control signals acting on the elevation aiming drive 9 and/or on the azimuth aiming drive 15 of the aiming system 5 of the mortar, in accordance with the present invention.

In order to automatically re-aim the weapon barrel after a shot has been fired, a device 26 that contains a gyroscope system 80 is attached to the cylindrical barrel guide 22 of the hinged bearing 17. As soon as this device 26 detects angular movements of the weapon barrel 2 (the device 26 detects differences in the orientation of the weapon barrel 2 to be selected), the device 26 produces appropriate electrical signals, in order to compensate for these differences. These signals are electronically processed by an electronic control unit (82), (See FIG. 7), and then act on the elevation aiming drive 9 and/or azimuth aiming drive 15, such that the angular movement errors are corrected virtually without any delay.

Figure 2:
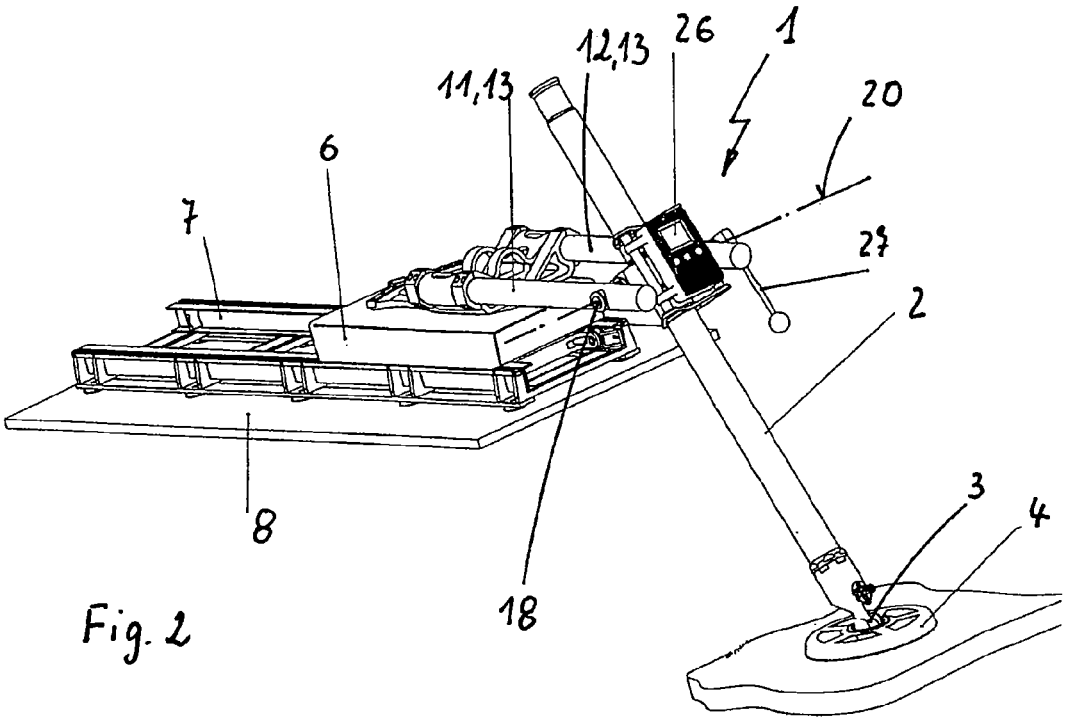
FIG. 2 shows a perspective view of the mortar illustrated in FIG. 1.
Figure 5:
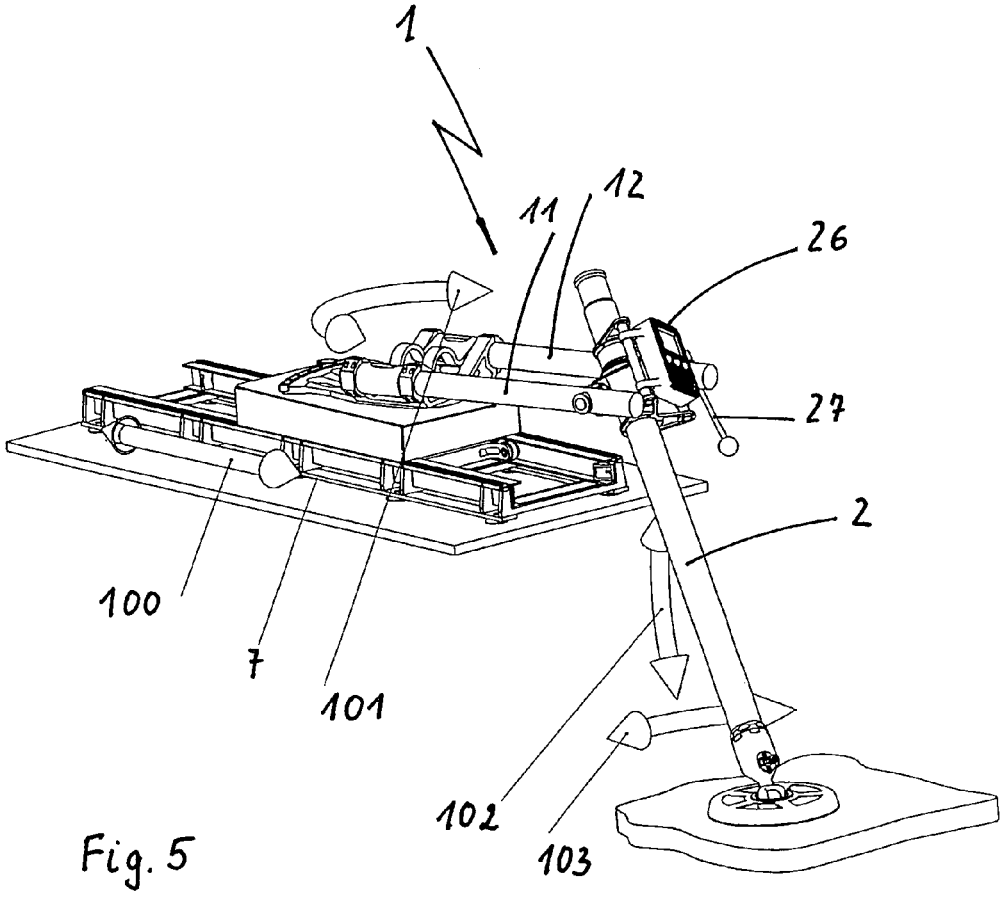
FIG. 5 shows a perspective illustration, corresponding to FIG. 2, of the mortar in the firing position as shown in FIG. 4.

As can be seen in particular from FIGS. 2 and 5, a control device 27 for manual adjustment of the hinged bearing 17 is provided at the side on the housing part 19 of the hinged bearing 17.

The method of operation of the mortar 1, according to the invention, will be described briefly in the following text. In this case, after it has been installed on the terrain, the mortar 1 may initially be placed in the initial position as illustrated in FIGS. 1 and 2.

Figure 4:
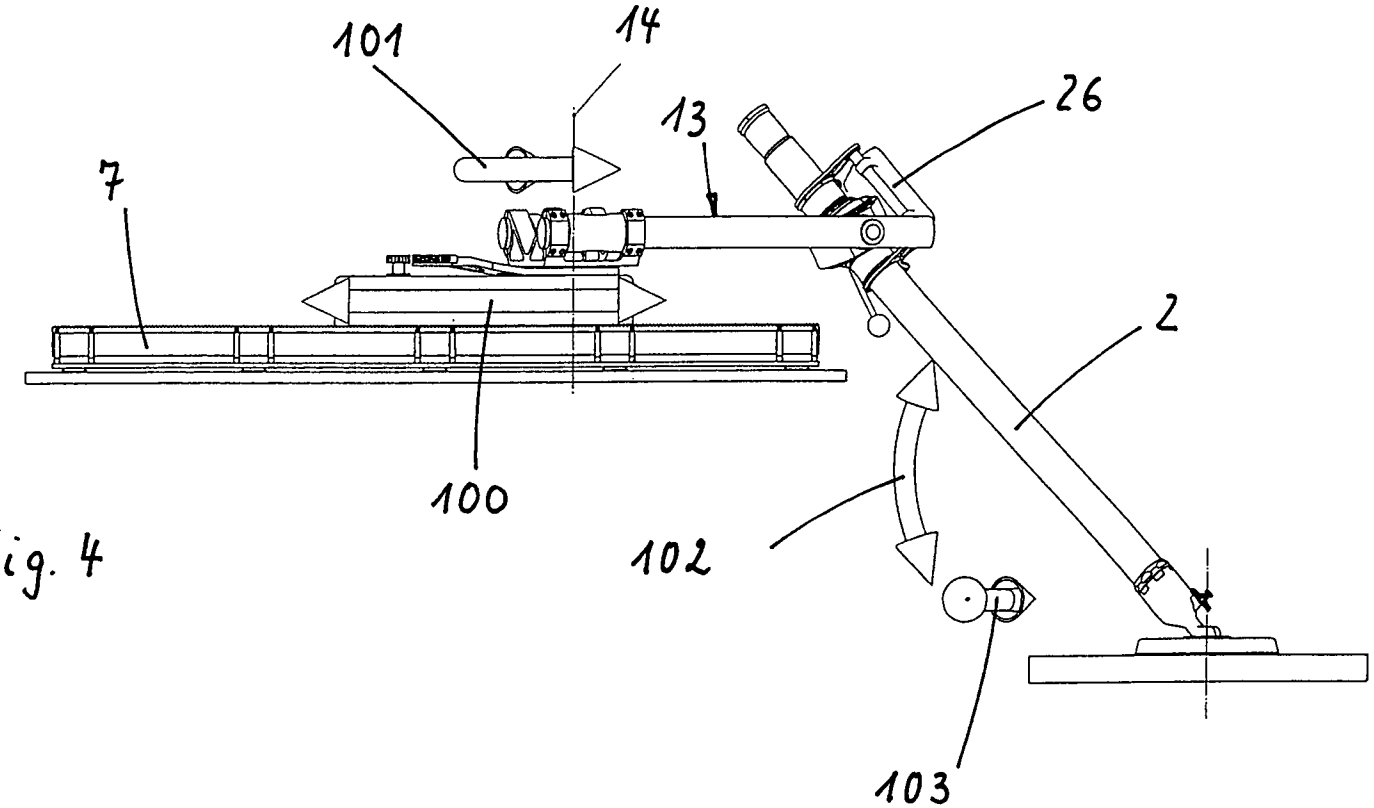
FIG. 4 shows a side view corresponding to FIG. 1 of the mortar in a firing position.

If it is now intended to fire at a specific target, then the elevation and azimuth aiming angles (and tilt angle) are determined, and the weapon barrel 2 is pivoted by moving the carriage 6 in the direction of the arrow 100 (FIGS. 4 and 5) with the aid of the elevation aiming drive, and by pivoting the pivoting arm 13 in the direction of the arrow 101 with the aid of the azimuth aiming drive 15, to the position illustrated in FIGS. 4 and 5 (i.e., a firing position). In this case, the corresponding pivoting movements of the weapon barrel 2 are indicated by the arrows 102 and 103 in FIGS. 4 and 5.

As soon as the firing position of the mortar 1 has been reached, the corresponding target can be fired at, with the device 26 ensuring that the three-dimensional orientation of the weapon barrel 2 is not changed by the firing of mortar projectiles. In this way, the integrity of the firing position is maintained even though the mortar has fired one or more mortar projectiles.

Figure 6:
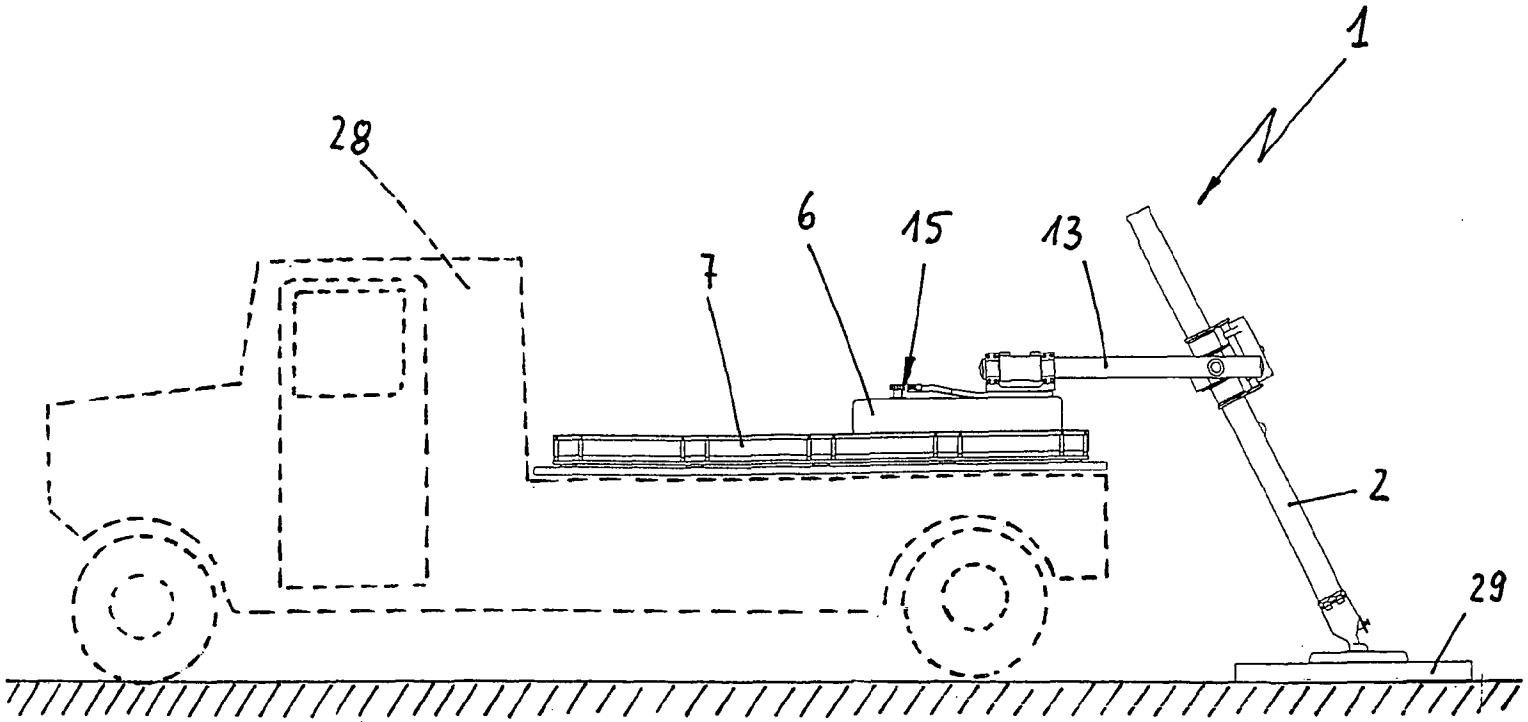
FIG. 6 shows a reduced-scale side view of the mortar illustrated in FIG. 1, which is located on the loading surface of a motor vehicle, which is indicated by dashed lines.

As FIG. 6 shows, the mortar 1 according to the invention can be used mounted on a vehicle 28, wherein the aiming system 5 is arranged on the appropriate carrier vehicle 28. In this case, the bottom supporting device 4 of the mortar 1 can rest on an earth bed 29, which is located adjacent to the carrier vehicle 28.

LIST OF REFERENCE SYMBOLS

1 Mortar
2 Weapon barrel
3 Ball-ended rod
4 Supporting device
5 Aiming system
6 Carriage
7 Guide path/guide strip
8 Base frame
9 First drive unit, elevation aiming drive
10 First end area
11, 12 Tubular parts
13 Pivoting arm
14 Pivoting axis
15 Second drive unit, azimuth aiming drive
16 Second end area
17 Hinged bearing
18 Bearing journal
19 Housing part
20 Horizontal axis
21 Inner part
22 Barrel guide
23 Bearing ball
24 Bearing shell
25 Depression, markings
26 Device for determining the three-dimensional barrel orientation
27 Control device
28 Carrier vehicle
29 Earth bed
80 Gyroscope system
82 Electronic control unit
90 First motor

95 Second motor
100-103 Arrows

The invention claimed is:

1. A mortar comprising:

(a) a bottom supporting device;

(b) at least one weapon barrel mounted to move via a ball-ended rod on the bottom supporting device; and (c) an aiming system operable to aim elevation and azimuth of the at least one weapon barrel, wherein the aiming system comprises:

i. a hinged bearing having a housing part, wherein the housing part has two open end faces and on an outside of the housing part a pivoting arm is mounted so that the pivoting arm is rotatable about a horizontal axis, and a rotatably mounted inner part is located in the pivoting arm, wherein the rotatably mounted inner part is connected to a cylindrical barrel guide for movable accommodation of the at least one weapon barrel, and the rotatably mounted inner part facilitates a de-coupled, axis-parallel installation of a system for determining geographical location to an interior component, wherein the system for determining geographical location comprises a gyroscope system, and ii. a carriage that moves along at least one guide path substantially horizontally toward the at least one weapon barrel or away from the at least one weapon barrel, wherein an end area of the pivoting arm is operably mounted on the carriage.

2. The mortar as claimed in claim 1, wherein a first end area of the pivoting arm is mounted on the carriage so that the pivoting arm is rotatable about a pivoting axis arranged at right angles to a plane of the carriage, and a second end area of the pivoting arm is connected to the hinged bearing, wherein the hinged bearing is disposed at a distance from the bottom supporting device and the hinged bearing guides movement of the at least one weapon barrel.

3. The mortar as claimed in claim 2, wherein, in order to move the carriage along the at least one guide path, the carriage is connected to a first drive unit that comprises a first actuating motor.

4. The mortar as claimed in claim 3, wherein, in order to rotate the pivoting arm, the pivoting arm is connected to a second drive unit that comprises a second actuating motor.

5. The mortar as claimed in claim 4, wherein a first device for determining a three-dimensional barrel orientation is attached to the cylindrical barrel guide of the hinged bearing, and the first device acts on the first drive unit and the second drive unit via an electronic control device.

6. The mortar as claimed in claim 5, wherein a manual control device is provided on the housing part for manual adjustment of the hinged bearing in azimuth.

7. The mortar as claimed in claim 1, wherein the at least one guide path is a guide strip in the form of a rail and is arranged on or adjacent to a base frame.

8. The mortar as claimed in claim 1, wherein, in order to rotate the pivoting arm, the pivoting arm is connected to a drive unit that comprises an actuating motor.

9. The mortar as claimed in claim 1, wherein the pivoting arm includes two parts in the form of rods or tubes, wherein the two parts are arranged parallel to one another and surround the housing part of the hinged bearing at sides of the housing part, and the two parts are connected to the housing part via bearing journals so that the two parts pivot.

10. The mortar as claimed in claim 2, wherein the pivoting arm includes two parts in the form of rods or tubes, wherein the two parts are arranged parallel to one another and surround the housing part of the hinged bearing at sides of the housing part, and the two parts are connected to the housing part via bearing journals so that the two parts pivot.

11. The mortar as claimed in claim 1, wherein the interior component comprises an electronic control unit.

* * * * *